US011655525B2

(12) United States Patent
Ther et al.

(10) Patent No.: US 11,655,525 B2
(45) Date of Patent: May 23, 2023

(54) CEMENTED CARBIDE FOR HIGH DEMAND APPLICATIONS

(71) Applicant: HYPERION MATERIALS & TECHNOLOGIES (SWEDEN) AB, Stockholm (SE)

(72) Inventors: Olivier Ther, Sant Fost de Campsentelles (ES); Olivier Lavigne, Barcelona (ES)

(73) Assignee: HYPERION MATERIALS & TECHNOLOGIES (SWEDEN) AB, Stockholm (SE)

( * ) Notice: Subject to any disclaimer, the term of this patent is extended or adjusted under 35 U.S.C. 154(b) by 0 days.

(21) Appl. No.: 17/291,057

(22) PCT Filed: Nov. 28, 2019

(86) PCT No.: PCT/IB2019/060285
§ 371 (c)(1),
(2) Date: May 4, 2021

(87) PCT Pub. No.: WO2020/128688
PCT Pub. Date: Jun. 25, 2020

(65) Prior Publication Data

US 2021/0388472 A1 Dec. 16, 2021

(30) Foreign Application Priority Data

Dec. 18, 2018 (GB) ..... 1820632

(51) Int. Cl.
*C22C 29/06* (2006.01)
*C22C 29/08* (2006.01)
(Continued)

(52) U.S. Cl.
CPC ..... *C22C 29/067* (2013.01); *B22F 3/15* (2013.01); *C22C 1/05* (2013.01); *C22C 29/08* (2013.01);
(Continued)

(58) Field of Classification Search
CPC ..... C22C 29/067; C22C 29/005; C22C 29/08; C22C 1/05; B22F 2301/15; B22F 2302/10; B22F 2005/002; B22F 3/15
See application file for complete search history.

(56) References Cited

U.S. PATENT DOCUMENTS 5,736,658 A * 4/1998 Mirchandani ..... C22C 29/067 75/242
9,453,271 B2 * 9/2016 Carpenter ..... C22C 19/055
(Continued)

FOREIGN PATENT DOCUMENTS

CN 102400027 A1 4/2012
EP 0028620 A1 5/1981
(Continued)

*Primary Examiner* — Humera N. Sheikh
*Assistant Examiner* — Kevin Ct Li

(57) ABSTRACT

Provided is a corrosion, erosion and wear resistant cemented carbide for high demand applications including, for example, use as a component within oil and gas production. The cemented carbide includes a hard phase and a binder phase. The cemented carbide may include, for example. Ni, Cr and Mo. The binder phase content of the cemented carbide is between 7 to 11 wt %. The WC of the cemented carbide may have an average grain size of from 0.1 to 2 μm.

7 Claims, 2 Drawing Sheets

(51) Int. Cl.
*C22C 1/05* (2023.01)
*B22F 3/15* (2006.01)

(52) U.S. Cl.
CPC ..... *B22F 2301/15* (2013.01); *B22F 2302/10* (2013.01)

(56) References Cited

U.S. PATENT DOCUMENTS

| | | | | |
|---|---|---|---|---|
| 2013/0199411 | A1* | 8/2013 | Carpenter | C22C 19/055 106/286.3 |
| 2017/0369973 | A1 | 12/2017 | Dorvlo | |

FOREIGN PATENT DOCUMENTS

| | | | |
|---|---|---|---|
| EP | 2439300 | A1 | 4/2012 |
| GB | 1350634 | A1 | 4/1974 |
| JP | 5195274 | B2 | 5/2013 |
| WO | 8002569 | A1 | 11/1980 |
| WO | 2017220533 | A1 | 12/2017 |

* cited by examiner

CEMENTED CARBIDE FOR HIGH DEMAND APPLICATIONS

This is a National Phase Application filed under 35 U.S.C. 371 as the national stage of PCT/IB2019/060285, filed on Nov. 28, 2019, an application claiming the benefit of Great Britain Patent Application No. 1820632.6, filed on Dec. 18, 2018, the entire content of each of which is hereby incorporated by reference in its entirety.

FIELD OF DISCLOSURE

The present subject matter relates to a wear resistant cemented carbide and method of manufacture for high demand applications and in particular although not exclusively to a corrosion and erosion resistance cemented carbide having a relatively high toughness for a given hardness.

BACKGROUND

Cemented carbides have been used extensively for high demand applications such as tools for cutting, machining, drilling or degrading rock. These high wear resistant carbides have found particular application as components within the oil and gas industry where they are used typically for a variety of fluid flow control components including for example choke and control valves, cages, valve seats and seal rings. Their suitability is due largely to their physical and mechanical characteristics including in particular hardness, toughness, strength and wear resistance. Within physical high demand oil and gas applications, conventional cemented carbide components have relatively short lifetimes. Additionally, prediction of in-service performance and the liability is critical due to limited accessibility (e.g. subsea environments) and the extensive production downtime for servicing.

Flow control components within oil and gas production systems are typically subjected to high fluid velocity flows (>200 m/s) where the fluid is typically mixed sand/oil/gas/water at variable humidity, flow rate and pH. Operating conditions can also include 'sour' conditions that include in particular exposure to $H_2S$ with an associated increased likelihood of corrosion, pitting and stepwise cracking.

The increasing challenging conditions of operation (including specifically high variability of the flow media and the extreme high pressure and high temperature) together with the deep-water environment mean that conventional components have a short service lifetime and are susceptible to high rates of failure.

WO 2017/220533 discloses a process line tool of a cemented carbide comprising in wt %: 2.9-11 Ni; 0.1-2.5 $Cr_3C_2$; 0.1-1 Mo and WC balance in which the WC comprises a grain size less than or equal to 0.5 μm.

CN 102400027 describes a corrosion resistant cemented carbide having wt % 7.3-7.7 Ni, 0.6-1 $Cr_3C_2$, 0.3-0.7 Mo and balance WC.

WO 2012/045815 describes a cemented carbide for oil and gas applications exhibiting galvanic corrosion resistance comprising WC and wt %: 3-11 Ni; 0.5-7 Cr; 0.3-1.5 Mo; 0-1 Nb and 0-0.2 Co.

WO 2016/107842 discloses a cemented carbide for fluid handling components such as a seal ring having a composition in wt % 7-11 Ni; 0.5-2.5 $Cr_3C_2$; 0.5-1 Mo and balance WC having a WC grain size greater than or equal to 4 μm.

However, under certain circumstances within oil and gas fluid flow control, existing cemented carbides are not optimised for corrosion and mechanical resistance and in particular wet erosion resistance. That is, existing cemented carbides exhibit an unsatisfactory rate of failure when the flow conditions are corrosive and erosive, in particular in the case of erosion induced by a slurry and/or a cavitation phenomenon.

SUMMARY

The present disclosure is directed to cemented carbide materials suitable for high demand applications and in particular for use as a constituent or primary material for a component part of such high demand applications. Also provided are cemented carbides having desired toughness, hardness, strength and wear resistant properties to withstand challenging environmental and operative conditions.

Also provided are cemented carbides suitable for use as a tool for metal forming or a wear part for fluid handling.

Also provided are cemented carbides suitable for use as a component part within oil and gas production including in particular use as a fluid flow component.

The objectives are achieved by a cemented carbide material having a relatively high hardness, toughness and transverse rupture strength (TRS). In particular, cemented carbide materials according to the present disclosure may comprise a hardness in a range 1550 to 1700 HV30 (ISO 3878:1983). Additionally, the present cemented carbide may comprise a toughness in a range 9 to 11 $MN/m^{3/2}$ (Palmqvist, ISO 28079:2009). Additionally, the present cemented carbides may comprise a TRS of greater than 3000 $N/mm^2$ (ISO 3327:2009).

There is provided a cemented carbide comprising a hard phase including WC and a binder phase characterised in that: the binder phase content of the cemented carbide is between 7 to 11 wt %; the cemented carbide comprises in wt % 5.9-9 Ni; 0.45-0.75 Cr; 0.55-0.85 Mo 30 and 85-95 or 87-94 WC; and wherein a grain size of the WC is in the range 0.1 to 2 μm determined by linear intercept.

Optionally, the cemented carbide comprises WC as balance wt %.

The present cemented carbide is particularly suited for use as a component and in particular a fluid flow control component having high erosion, abrasion and corrosion resistance and in particular wet erosion resistance. The present cemented carbide is therefore particularly suited for use as a component within oil and gas production. In particular, the inventors have identified that the recited carbide grade provides high cavitation, corrosion and erosion resistance due, in part, to the recited composition and in particular the binder content (relative to hard phase content) and WC grain size. The present cemented carbide provides a component having significantly enhanced slurry erosion resistance and improved cavitation resistance (associated with toughness).

The cemented carbide comprises Cr, Mo and W in any one or in combination of free/elemental form, or as a compound in combination with any or a combination of the other constituents of the cemented carbide.

Optionally, there is provided a cemented carbide comprising a hard phase including WC and a binder phase; the binder phase content of the cemented carbide is between 7 to 11 wt %; and the cemented carbide consists of in wt % 5.9-9 Ni; 0.45-0.75 Cr; 0.55-0.85 Mo and if present any one or a combination of Fe, Co, Ti, Nb, Ta, V, Re, Ru, Zr, Al and/or Y at impurity levels; and wherein a grain size of the WC is in the range 0.1 to 2 μm determined by linear intercept.

Preferably the cemented carbide comprises exclusively carbides. Preferably the cemented carbide comprises WC as a predominant wt % carbide component. Optionally, the cemented carbide may comprise minority wt % carbides of any one or a combination of Mo and Cr.

Optionally, the cemented carbide is devoid of nitrides and/or carbonitrides. Optionally, the cemented carbide may comprise nitrides and/or carbonitrides present at impurity level. Optionally, the impurity level of such nitrides and/or carbonitrides is less than 0.05, 0.01 or 0.001 wt %. Optionally, the cemented carbide is devoid of Ti and carbides, nitrides and/or carbonitrides of Ti. Preferably, the cemented carbide comprises 0 wt % Ti so as to be compositionally free of Ti.

Optionally, in some aspects substantially all, a majority or a predominant component in wt % of Ni, Cr and Mo are present within the binder phase. That is, in certain embodiments, a minor or relatively low amount (i.e. wt % less than 10, 5, 2 or 1%) of the total wt % amount of each of Ni, Cr and/or Mo may be present outside/beyond of the binder phase. Such minor amounts may be present at the grain boundaries between the hard phase and the binder phase or within the hard phase.

Optionally, the hard phase of the cemented carbide is at least 85, 86, 87, 88, 89, 90, 91, 92, 93 wt %. Optionally, the amount of WC in the cemented carbide is at least 85 wt % or 87 wt % or in a range 85 to 95, 87 to 94, 88 to 93 or 89 to 92 wt %. Optionally, a carbon content within the sintered cemented carbide is maintained within a predetermined range to further contribute to the high wet erosion resistance, wear resistance and toughness. Optionally, the carbon content of the sintered material may be held in a range between free carbon in the micro structure (upper limit) and a point of eta-phase initiation (lower limit). Such limits will be appreciated by those skilled in the art.

Optionally, a quotient wt % Cr/(Ni+Cr+Mo) in the cemented carbide is in a range 0.03 to 0.1; 0.04 to 0.1; 0.05 to 0.1; 0.06 to 0.1 or 0.07 to 0.09. This relative amount of Cr enhances the corrosion and wet erosion resistance while maintaining the desired mechanical properties including hardness and toughness required for the high demand applications such as oil and gas.

Optionally, a quotient wt % Mo/(Ni+Cr+Mo) in the cemented carbide is in a range 0.04 to 0.12; 0.04 to 0.1; 0.05 to 0.1; 0.06 to 0.1 or 0.07 to 0.09. The concentration of Mo within the cemented carbide enhances the corrosion and wet erosion resistance whilst maintaining the desired mechanical properties including hardness and toughness required for the mechanically demanding applications.

The amount (wt %) of binder phase relative to the WC hard phase has been found to enhance toughness whilst maintaining hardness to an appropriate level for high demand applications. The relative binder content also provides a contribution to the enhanced corrosion resistance and in particular wet erosion resistance. Optionally, the cemented carbide may comprise a binder phase at wt % 7.0 to 11.0; 7.5 to 10.5; 8.0 to 10.5; 8.5 to 10 or 8 to 10.

Optionally, a grain size of the WC within the final, sintered cemented carbide may be in the range 0.1 to 2 μm; 0.2 to 1.8 μm; 0.2 to 1.6; 0.2 to 1.4; 0.2 to 1.2; 0.2 to 1.0; 0.3 to 0.9; 0.4 to 0.8; or 0.5 to 0.7 μm as determined by linear intercept. Optionally, a FSSS grain size of the starting WC material may be in the range 0.4 to 2 μm or 0.5 to 1.5 μm. Such grain sizes provide enhanced toughness whilst maintaining hardness and configure the cemented carbide with enhanced capability to withstand sheer forces and stress. Preferably, the grain size of the WC within the sintered material measured by linear intercept is in the range 0.3 to 0.9 μm.

Optionally, the cemented carbide comprises Ni in a range wt % 7.0 to 8; 7.1 to 7.9; 7.2 to 7.8; 7.3 to 7.8; 7.4 to 7.7; or 7.4 to 7.6. Optionally, the cemented carbide comprises Cr in a range wt % 0.55 to 0.75; 0.57 to 0.73; 0.59 to 0.71; 0.61 to 0.69; or 0.63 to 0.67. Optionally, the cemented carbide comprises Mo in a range wt % 0.65 to 0.8; 0.67 to 0.8; 0.7 to 0.8; 0.71 to 0.79; 0.72 to 0.78; or 0.73 to 0.77. The recited composition ranges including specifically the amount of Ni, Cr and Mo in addition to the binder content and WC grain size provides a composition exhibiting particularly high wet erosion resistance commonly encountered for components within oil and gas applications. Accordingly, the present cemented carbide is particularly suited for use as a component comprising any one of a choke valve, a control valve, a valve seat, a plug seat, a frac seat, a cage, a cage assembly, a seal ring, a component part of a valve to allow the through-flow of a fluid and/or a slurry. According to one aspect, the present cemented carbide may be used as a tool for metal forming including in particular use as a die, an ironing die, a die for wire drawing or other component within metal forming.

There is provided a cemented carbide comprising a hard phase including WC and a binder phase characterised in that: the binder phase content of the cemented carbide is between 7 to 11 wt %; the cemented carbide comprises in wt % 5.9-9 Ni; 0.45-0.75 Cr; 0.55-0.85 Mo and WC as balance; and wherein a grain size of the WC is in the range 0.1 to 2 μm determined by linear intercept.

There is also provided a method of making a cemented carbide article comprising a hard phase including WC and a binder phase, the method comprising and characterised by: preparing a powdered batch comprising raw materials in wt % 6-9 Ni; 0.45-0.75 Cr; 0.55-0.85 Mo and WC included as balance; pressing the powdered batch to form a pre-form; and sintering the pre-form to form the article; wherein the binder phase content of the cemented carbide is between 7 to 11 wt % and a particle size of the WC included as a starting material within the powdered batch is in the range 0.4 to 2 μm determined by FSSS.

There is also provided a method of making a cemented carbide article comprising a hard phase including WC and a binder phase, the method comprising and characterised by: preparing a powdered batch comprising raw materials in wt % 6-9 Ni; 0.45-0.75 Cr; 0.55-0.85 Mo and 85-95 WC; pressing the powdered batch to form a pre-form; and sintering the pre-form to form the article; wherein the binder phase content of the cemented carbide is between 7 to 11 wt % and a particle size of the WC included as a starting material within the powdered batch is in the range 0.4 to 2 μm determined by FSSS.

Optionally, the step of sintering the pre-form to form the article comprises vacuum or HIP processing. Optionally, the sintering processing comprises processing at a temperature 1360-1500° C. and a pressure 0-20 MPa.

There is also provided an article for high demand applications manufactured by the method as described herein.

There is also provided a cemented carbide article obtainable by the method as described herein.

Optionally, the Cr may be added to part of the powdered batch in the form $Cr_3C_2$.

Optionally, the method may comprise adding elemental Cr. According to such implementations, the method may further comprise adding additional carbon so as to achieve the desired wt % carbon within the sintered cemented carbide in a range between free carbon in the microstructure (upper limit) and eta-phase initiation (lower limit) as will be appreciated by those skilled in the art. Optionally, the FSSS WC particle size within the powdered batch may be in the range 0.4 to 2 μm; 0.6 to 1.8; 0.8 to 1.6; 0.8 to 1.4; or 0.8 to 1.2.

Optionally, the present cemented carbide is a tungsten cemented carbide.

The present cemented carbide may further comprise carbides, nitrides and/or carbonitrides selected from the group of tungsten, titanium, chromium, vanadium, tantalum, neodymium, niobium and molybdenum. Such components may be added to the powder batch as minor wt % additives relative to WC that preferably is included within the cemented carbide as a majority or predominant wt % component relative to other components of the material.

Optionally the cemented carbide may comprise metallic phase components including iron, chromium, nickel, cobalt, molybdenum or combinations thereof. Such components may be present within the binder phase. Preferably the present cemented carbide is devoid of cobalt (i.e., comprises zero or near zero wt % cobalt) so as to be compositionally free of Co. Optionally the cemented carbide may comprise cobalt at impurity levels being of the order of less than 0.01, 0.05, 0.01 or 0.001 wt %.

Optionally, the cemented carbide is devoid of nitrogen or nitrogen compounds. However, the cemented carbide may comprise nitrogen or nitrogen compounds such as nitrides at impurity level such as less than 0.1 wt %, 0.05 wt % or 0.01 wt %.

Optionally, the present cemented carbide may further include any of Fe, Ti, Nb, Ta, V, Re, Ru, Zr, Al and/or Y at impurity levels. These elements may be present either in elemental, carbide, nitride or carbonitride form. The impurity level is a level such as less than 0.1 wt % or 0.5 wt % for the total amount of impurities present within the cemented carbide

BRIEF DESCRIPTION OF DRAWINGS

A specific implementation of the present invention will now be described, by way of example only, and with reference to the accompanying drawings in which.

DETAILED DESCRIPTION

Figure 1:
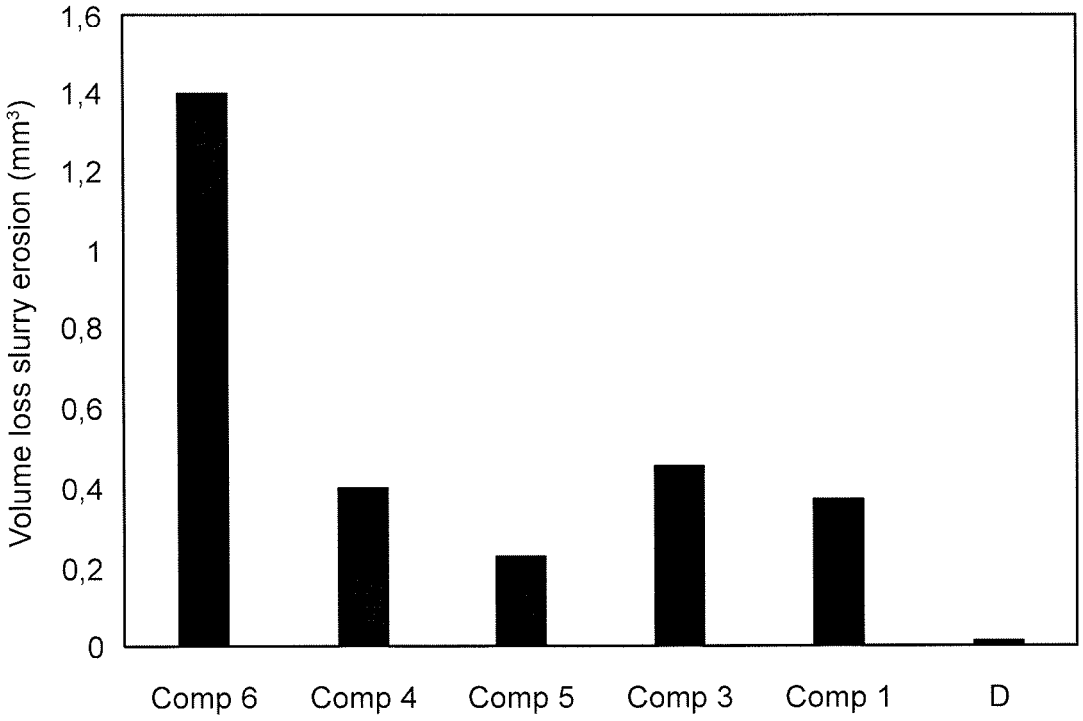
FIG. 1 is a graph of volume of material loss due to slurry erosion ($mm^3$) for different example materials according to aspects of the present invention in addition to comparative examples.

A wear resistant cemented carbide grade is provided with relative high toughness and exhibiting enhanced corrosion and erosion resistance. The inventors have identified that such physical and mechanical characteristics may be achieved via a binder phase content relative to a WC hard phase of in the range 7 to 11 wt % and in which the cemented carbide has a wt % composition 5.9-9 Ni; 0.45-0.75 Cr; 0.55-0.85 Mo and WC included as balance. The desired physical and mechanical characteristics are also achieved by controlling the grain size of WC as determined by Fisher Model 95 Sub-Sieve Sizer™ (FSSS) in the range 0.1 to 2 μm and preferably 0.2 to 1 μm. In particular, the inventors identify that the grain size of these sintered cemented carbide provides enhanced wet erosion resistance as would typically be encountered by a fluid flow control component exposed to a slurry as typically encountered within oil and gas applications.

The present cemented carbide is specifically adapted for potential high wear and high demand applications including use as a component within oil and gas production with such components being susceptible to corrosion and mechanical erosion (including in particular wet erosion). The present carbide is also suitable for the use as a tool for metal forming or as a wear part for fluid handling.

EXAMPLES

Conventional powder metallurgical methods including milling, pressing, shaping and sinter hipping were used to manufacture a cemented carbide according to the present invention. Cemented carbide materials according to the present invention were prepared in addition to comparative test coupons.

Each of the sample mixtures Grades A to G were prepared from powders forming the hard constituents and powders forming the binder. The following preparation method corresponds to Grade E of Table 1 below having starting powdered materials: WC 95.05 g, Cr3C2 0.61 g, Ni 6.89 g, C 0.07 g, Mo 0.61 g, PEG 2 g, Ethanol 50 ml. It will be appreciated by those skilled in the art that it is the relative amounts of the powdered materials that allow the skilled person and suitable adjustment is needed to make the powdered batch and achieve the final fully sintered composition of the cemented carbides of Table 1. The powders were wet milled together with lubricant and anti-flocculating agent until a homogeneous mixture was obtained and granulated by drying and sieving. The dried powder was pressed to form a green part according to the abovementioned standard shapes and sintered using SinterHIP at 1350-1500° C. and 5 MPa.

Table 1 details composition (wt %) together with additional characterisations of grades A to G in accordance with the present invention.

TABLE 1

Example grade material compositions A to G according to the present invention.

| | Composition, wt % | | | | | WC Raw | $Cr_3C_2$/ | Mo/ |
|---|---|---|---|---|---|---|---|---|
| Grade | WC | $Cr_3C_2$ | Ni | Mo | Total binder | Material μm | Binder Tot | Binder Tot |
| A | 89.30 | 0.85 | 9.00 | 0.85 | 10.70 | 0.8 | 0.08 | 0.08 |
| B | 89.30 | 0.85 | 9.00 | 0.85 | 10.70 | 0.4 | 0.08 | 0.08 |
| C | 91.00 | 0.75 | 7.50 | 0.75 | 9.00 | 0.8 | 0.08 | 0.08 |
| D | 91.00 | 0.75 | 7.50 | 0.75 | 9.00 | 1 | 0.08 | 0.08 |

TABLE 1-continued

Example grade material compositions A to G according to the present invention.

| Grade | Composition, wt % WC | $Cr_3C_2$ | Ni | Mo | Total binder | WC Raw Material µm | $Cr_3C_2$/ Binder Tot | Mo/ Binder Tot |
|---|---|---|---|---|---|---|---|---|
| E | 92.00 | 0.60 | 6.80 | 0.60 | 8.00 | 1 | 0.08 | 0.08 |
| F | 93.00 | 0.55 | 5.90 | 0.55 | 7.00 | 1 | 0.08 | 0.08 |
| G | 93.00 | 0.55 | 5.90 | 0.55 | 7.00 | 2 | 0.08 | 0.08 |

Hardness tests were carried out on grades A to G in accordance with ISO 3878 and toughness testing according to Palmqvist, ISO 28079. Vickers indentation test was performed using 30 kgf (HV30) to assess hardness. Palmqvist fracture toughness was calculated according to:

$$K1c = A\sqrt{HV}\sqrt{\frac{P}{\Sigma L}}$$

Where A is a constant of 0.0028, HV is the Vickers hardness in N/mm2, P is the applied load (N) and ΣL is the sum of crack lengths (mm) of the imprint. The results are shown in table 2.

TABLE 2

Hardness and toughness tests for sample grades A to G.

| Grade | HV30 | KIC |
|---|---|---|
| A | 1581 | 9.4 |
| B | 1622 | 9.3 |
| C | 1683 | 9.3 |
| D | 1587 | 9.7 |
| E | 1591 | 9.6 |
| F | 1664 | 9.5 |
| G | 1593 | 9.2 |

Table 3 details example grade D together with comparative examples 1 to 6 according to various different compositions and WC starting material particle sizes. It will be appreciated the particle size of the starting material is reduced according to standard milling and sintering procedures such that the grain size of the final fully sintered material (determined by linear intercept) may be less than (up to or approximately half) the particle size of the starting material (determined by FSSS).

The linear intercept method (ISO 4499-2:2008) is a method of measurement of WC grain size. Grain-size measurements are obtained from SEM images of the microstructure. For a nominally two-phase material such as a cemented carbide (hard phase and binder phase), the linear-intercept technique gives information of the grain-size distribution. A line is drawn across a calibrated image of the microstructure of the cemented carbide. Where this line intercepts a grain of WC, the length of the line ($l_i$) is measured using a calibrated rule (where i=1, 2, 3, . . . n for the first $1^{st}$, $2^{nd}$, $3^{rd}$, . . . , nth grain). At least 100 grains where counted for the measurements. The average WC grain size will be defined as:

$$d_{WC}=\Sigma l_i/n$$

TABLE 3

Compositions of example grade D with various comparative examples 1 to 6.

| Grade | WC | (TiC, TaC, NbC) | Co | $Cr_3C_2$ | Ni | Mo | WC Raw Material, µm |
|---|---|---|---|---|---|---|---|
| D | 91 | 0 | 0 | 0.75 | 7.50 | 0.75 | 1 |
| Comparative 1 | 90.9 | 0 | 0 | 0.80 | 8.02 | 0.28 | 5 |
| Comparative 2 | 89.81 | 0 | 0 | 0.80 | 8.49 | 0.80 | 8 |
| Comparative 3 | 88.6 | 0 | 0 | 0.90 | 9.60 | 0.9 | 0.8 |
| Comparative 4 | 87.8 | 0 | 3.5 | 1.5 | 7 | 0.2 | 0.8 |
| Comparative 5 | 94.9 | 0 | 3.3 | 0.6 | 1.1 | 0.1 | 0.8 |
| Comparative 6 | 88 | 5 | 1.2 | 1.2 | 3.6 | 0 | 2 |

Hardness (ISO 3878), toughness (Palmqvist, ISO 28079) and TRS (ISO 3327:2009) tests were undertaken on grade D, as well as comparative examples 1 to 6. The test pieces for transverse rupture strength's determination were cylinders of Type C (cylindrical cross-section with 40×3 mm2 dimension). The samples were placed between two supports and loaded in their center until fracture occurred (3-points bending). The maximum load was recorded and averaged over minimum five samples per test. The results are shown in table 4.

TABLE 4

Physical and mechanical performance test results of grade D and comparative examples 1 to 6.

| Grade | HV30 | KIC | TRS |
|---|---|---|---|
| D | 1587 | 9.7 | 4050 |
| Comparative 1 | 1344 | 13.8 | 3900 |
| Comparative 2 | 1210 | 12.2 | 3025 |
| Comparative 3 | 1550 | 9.5 | 4550 |
| Comparative 4 | 1540 | 10.3 | 3300 |

TABLE 4-continued

Physical and mechanical performance test results of grade D and comparative examples 1 to 6.

| Grade | HV30 | KIC | TRS |
|---|---|---|---|
| Comparative 5 | 1904 | 8.8 | 3800 |
| Comparative 6 | 1934 | 8.7 | 2275 |

The corrosion rate of grade D and comparative examples 1, 3, 4, 5 and 6 was assessed and the results are shown in table 5. The surface roughness (Ra) of the samples was 0.036 μm. The corrosion rate in mm/year was estimated by means of mass loss against time of immersion under the following simulated test conditions:

1) Immersion for 212 h in synthetic sea water at pH 6 (3.56% wt. NaCl) at 25° C., in aerated conditions.
2) Immersion for 212 h in synthetic sea water at pH 1 (3.56% wt. NaCl+0.1M $H_2SO_4$) at 60° C., in aerated conditions.

The mass loss corrosion rate in mm/year was estimated according to the above simulated conditions using the formula (ASTM G31-72 *'Standard Practice for Laboratory Immersion Corrosion Testing of Metals'*):

$$\text{Corrosion rate}=8.76\times10^4\times((\text{weight loss (g)}/(\text{exposed surface area (cm}^2)\times\text{density (g/cm}^3)\times\text{immersion time (h)}))$$

TABLE 5

Corrosion immersion testing results for grades D and comparative examples 1,3, 4, 5 and 6.

| Grade | Material loss (mm/year) in synthetic seawater at pH 6, and 25° C. | Material loss (mm/year) in synthetic seawater at pH 1, and 60° C. |
|---|---|---|
| D | $0.51\times10^{-3}\pm0.14\times10^{-3}$ | $69.28\times10^{-3}\pm0.46\times10^{-3}$ |
| Comparative 1 | $4.11\times10^{-3}\pm0.68\times10^{-3}$ | $72.31\times10^{-3}\pm1.08\times10^{-3}$ |
| Comparative 3 | $3.46\times10^{-3}\pm0.34\times10^{-3}$ | $55.34\times10^{-3}\pm0.96\times10^{-3}$ |
| Comparative 4 | $4.14\times10^{-3}\pm0.69\times10^{-3}$ | $105.52\times10^{-3}\pm12.03\times10^{-3}$ |
| Comparative 5 | $1.94\times10^{-3}\pm0.96\times10^{-3}$ | $94.05\times10^{-3}\pm3.65\times10^{-3}$ |
| Comparative 6 | $3.28\times10^{-3}\pm1.36\times10^{-3}$ | $68.31\times10^{-3}\pm5.99\times10^{-3}$ |

The corrosion resistance of grade D together with comparative example 1, 3, 4, 5 and 6 was tested by means of polarization (potentiodymamic) curves in synthetic sea water at pH 1 (3.56% wt. NaCl) at 25° C. in aerated conditions. The surface roughness (Ra) of the samples was 0.017 μm. Firstly, the open circuit potential (OCP) was recorded for 1 h, secondly the polarization resistance was estimated by applying a potential to the sample from −5 mV to +5 mV around the OCP at a scanning rate of 0.166 mV/s, finally a cyclic polarization was applied to the sample at 0.5 mV/s, from the OCP in the anodic direction to a maximum current of 5 mA/cm$^2$, then reversed. The results are shown in Table 6.

TABLE 6

Corrosion resistance: OCP, breakdown or pitting potential, repassivation potential and polarization resistance of grade D and comparative examples 1, 3, 4, 5 and 6.

| Grade | OCP after 1 h (mV/Ag/AgCl) | Breakdown or pitting potential (mV/Ag/AgCl) | Repassivation potential (mV/Ag/AgCl) | Polarization resistance (Ω · cm$^2$) |
|---|---|---|---|---|
| D | −180 | 860 | N/A | 2051 ± 307 |
| Comparative 1 | −160 | 860 | N/A | 1743 ± 363 |
| Comparative 3 | −130 | 565 | 110 | 1044 ± 129 |
| Comparative 4 | −170 | 790 | N/A | 1223 ± 272 |
| Comparative 5 | −145 | −90 | none | 809 ± 157 |
| Comparative 6 | −130 | 860 | N/A | 2687 ± 239 |

Wet (slurry) erosion resistance of the grades of table 3 was tested using a wet slurry erosion rig under the following conditions:

3.5% NaCl simulated sea-water slurry solution
Erodent size: ~181-250 μm
slurry flow rate of ~41 L/min;
jet flow velocity of ~24 m/s;
slurry concentration of ~2.1% wt/wt
120 minutes running time
30° angle The results are shown in FIG. 1 which is a graph of volume of material loss during slurry erosion testing according to the above conditions. As will be noted, grade C exhibited the lowest volume loss relative to all the comparative examples tested.

Figure 2:
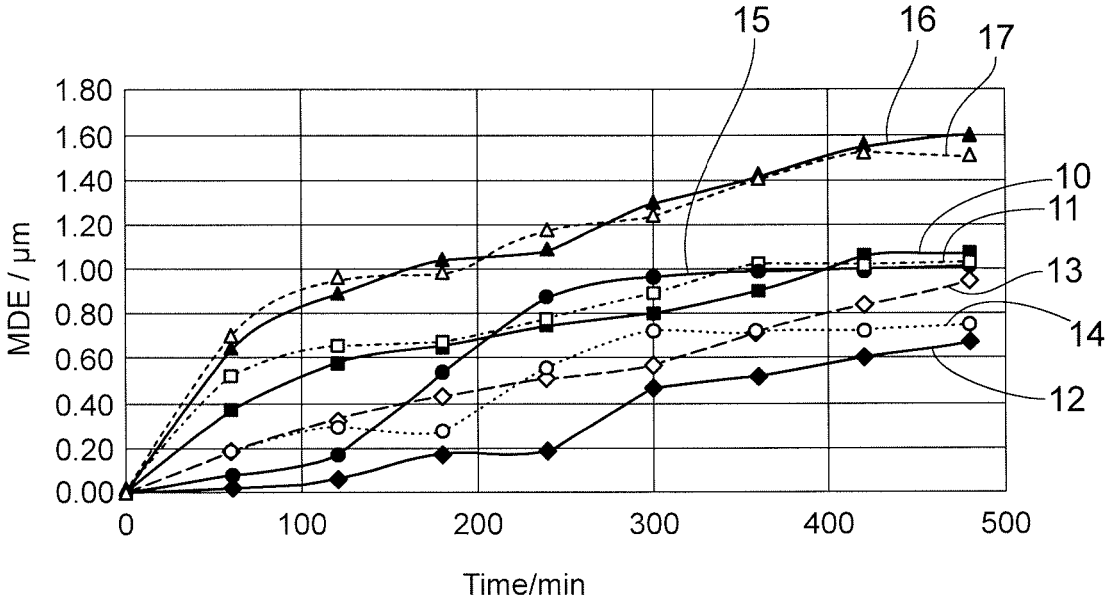
FIG. 2 is a graph of wear induced by cavitation over time for different example materials according to aspects of the present invention in addition to comparative examples.

The cavitation erosion resistance of grade D and comparative examples 3 to 5 were tested in 3.5% NaCl solution at 25° C. following ASTM G 32-7 ('*Standard test method for cavitation erosion using vibratory apparatus*'). The results are shown in FIG. 2 which is a graph of normalized cumulative mean depth of erosion (MDE) vs time/min of exposure to the cavitation horn. As will be noted, each sample (D and examples 3 to 5) comprises two sets of results, corresponding to two separate tests of the cavitation erosion resistance as described. Grade C is represented by lines 12 and 13. Comparative 3 is represented by lines 10 and 11. Comparative 4 is represented by lines 14 and 15. Comparative 5 is represented by lines 16 and 17. As will be noted, the MDE of grade D (line 12) was the lowest of all MDE tested samples. According, the present cemented carbide material (grade D) exhibited high wear (wet erosion resistance) in combination with enhanced toughness and corrosion resistance.

Unless defined otherwise all technical and scientific terms used herein have the same meaning as commonly understood to one of ordinary skill in the art to which the presently described subject matter pertains.

Unless otherwise indicated, any reference to "wt %" refers to the mass fraction of the component relative to the total mass of the cemented carbide.

Where a range of values is provided, for example, concentration ranges, percentage range or ratio ranges, it is understood that each intervening value, to the tenth of the unit of the lower limit, unless the context clearly dictates otherwise, between the upper and lower limit of that range and any other stated or intervening value in that stated range, is encompassed within the described subject matter. The upper and lower limits of these smaller ranges may independently be included in the smaller ranges, and such embodiments are also encompassed within the described subject matter, subject to any specifically excluded limit in the stated range. Where the stated range includes one or both of the limits, ranges excluding either or both of those included limits are also included in the described subject matter.

It should be understood that the terms "a" and "an" as used above and elsewhere herein refer to "one or more" of the enumerated components. It will be clear to one of ordinary skill in the art that the use of the singular includes the plural unless specifically stated otherwise. Therefore, the terms "a", "an" and "at least one" are used interchangeably in this application.

Unless otherwise indicated, all numbers expressing quantities of ingredients, properties such as size, weight, reaction conditions and so forth used in the specification and claims are to be understood as being modified in all instances by the term "about". Accordingly, unless indicated to the contrary, the numerical parameters set forth in the following specification and attached claims are approximations that may vary depending upon the desired properties sought to be obtained by the present subject matter. At the very least, and not as an attempt to limit the application of the doctrine of equivalents to the scope of the claims, each numerical parameter should at least be construed in light of the number of reported significant digits and by applying ordinary rounding techniques.

Throughout the application, descriptions of various embodiments use "comprising" language; however, it will be understood by one of skill in the art that, in some instances, an embodiment can alternatively be described using the language "consisting essentially of" or "consisting of".

The present subject matter being thus described, it will be apparent that the same may be modified or varied in many ways. Such modifications and variations are not to be regarded as a departure from the spirit and scope of the present subject matter, and all such modifications and variations are intended to be included within the scope of the following claims.

The invention claimed is:

1. A cemented carbide having a hard phase and a binder phase, the cemented carbide consisting of:

Ni present in an amount of 7.50 by weight (wt.)% based on a total amount of the cemented carbide;

Cr present in an amount of 0.75 by wt. % based on a total amount of the cemented carbide;

Mo present in an amount of 0.75 by wt. % based on a total amount of the cemented carbide; and WC present in an amount of 91 by wt. % based on a total amount of the cemented carbide, wherein the binder phase is present in an amount of 9 by wt. % based on a total amount of the cemented carbide, and wherein the WC has a grain size of 1 μm.

2. The cemented carbide of claim 1, wherein a quotient of Cr/(Ni+Cr+Mo) in the cemented carbide is from 0.03 to 0.10.

3. The cemented carbide of claim 1, wherein a quotient of Mo/(Ni+Cr+Mo) in the cemented carbide is in a range of from 0.04 to 0.12.

4. A component selected from the group consisting of a choke valve, a control valve, a valve seat, a plug seat, a frac seat, a cage, a cage assembly, a seal ring, and a component part of a valve to allow the through-flow of a fluid and a slurry, the component comprising the cemented carbide of claim 1.

5. A method of making a cemented carbide article having a hard phase and a binder phase, the method comprising:

preparing a powdered batch consisting of raw materials in weight (wt.)% of 7.50 Ni; 0.75 Cr; 0.75 Mo; and 91 WC based on a total amount of the powdered batch;

pressing the powdered batch to form a pre-form; and sintering the pre-form to form the cemented carbide article, wherein the binder phase of the cemented carbide article is present in an amount of 9 by wt. % based on a total amount of the cemented carbide article, and the WC included in the powdered batch has a particle size of 0.4 μm to 2 μm determined by Fisher sub sieve sizer (FSSS), and wherein the sintered WC has a grain size of 1 μm.

6. The method of claim 5, wherein the sintering the pre-form to form the cemented carbide article comprises vacuum or HIP processing.

7. The method of claim 5, wherein the sintering comprises processing at a temperature 1360° C.-1500° C. and a pressure 0-20 MPa.

* * * * *